US007040952B1

(12) United States Patent
Srivatsan et al.

(10) Patent No.: US 7,040,952 B1
(45) Date of Patent: May 9, 2006

(54) METHOD FOR REDUCING OR ELIMINATING DE-LAMINATION OF SEMICONDUCTOR WAFER FILM LAYERS DURING A CHEMICAL MECHANICAL PLANARIZATION PROCESS

(75) Inventors: Sridharan Srivatsan, Sunnyvale, CA (US); Ramesh Gopalan, Fremont, CA (US); K. Y. Ramanujam, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 108 days.

(21) Appl. No.: 10/186,912

(22) Filed: Jun. 28, 2002

(51) Int. Cl.
*B24B 49/00* (2006.01)

(52) U.S. Cl. ..... 451/5; 451/11; 451/41; 451/60; 451/285

(58) Field of Classification Search ..... 451/41, 451/59, 60, 63, 285–289, 5, 11
See application file for complete search history.

(56) References Cited

U.S. PATENT DOCUMENTS 5,582,534 A * 12/1996 Shendon et al. ..... 451/41
5,759,918 A * 6/1998 Hoshizaki et al. ..... 438/692
5,770,521 A * 6/1998 Pollock ..... 438/692
5,851,136 A * 12/1998 Lee ..... 451/9
5,938,884 A * 8/1999 Hoshizaki et al. ..... 156/345.14
6,102,776 A * 8/2000 Boggs et al. ..... 451/8
6,315,857 B1 * 11/2001 Cheng et al. ..... 156/345.12
6,464,574 B1 * 10/2002 Halley ..... 451/490
6,843,711 B1 * 1/2005 Muldowney ..... 451/527
2003/0203709 A1 * 10/2003 Peng et al. ..... 451/57

* cited by examiner

*Primary Examiner*—M. Rachuba
(74) *Attorney, Agent, or Firm*—Martine Penilla & Gencarella, LLP

(57) ABSTRACT

A method for preventing de-lamination of semiconductor wafer film stacks during a linear belt-type chemical mechanical planarization (CMP) process is provided. The method implements a pulsed polishing head rotation during a CMP process to maintain a slurry distribution across the width of a belt pad. The slurry distribution is maintained in a manner that prevents de-lamination of a wafer film having weak adhesion characteristics. Thus, the pulsed polishing head rotation implemented by the method reduces de-lamination of low-K material film layers during the CMP process.

7 Claims, 8 Drawing Sheets

METHOD FOR REDUCING OR ELIMINATING DE-LAMINATION OF SEMICONDUCTOR WAFER FILM LAYERS DURING A CHEMICAL MECHANICAL PLANARIZATION PROCESS

BACKGROUND OF THE INVENTION

1. Field of the Invention

The present invention relates generally to chemical mechanical planarization (CMP) methods and systems, and more particularly, to a method for pulsing or oscillating a polishing head to reduce or prevent de-lamination of a semiconductor wafer film layers during a CMP process.

2. Description of the Related Art

In the fabrication of semiconductor devices, planarization operations of silicon wafers, which can include polishing, buffing, and cleaning, are often performed. Typically, integrated circuit devices are in the form of multi-level structures on silicon substrate wafers. At the substrate level, transistor devices with diffusion regions are formed. In subsequent levels, interconnect metallization lines are patterned and electrically connected to the transistor devices to define the desired functional device. Patterned conductive layers are insulated from other conductive layers by dielectric materials. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed into the dielectric material, and then metal planarization operations are performed to remove excess metallization.

Planarizing metallization layers, specifically copper metallization layers is becoming more important as copper has begun to replace aluminum as the metal of choice for metallization processes. One method for achieving semiconductor wafer planarization is the Chemical Mechanical Planarization (CMP) technique. Further applications include planarization of dielectric films deposited prior to the metallization process, such as dielectrics used for shallow trench isolation or for poly-metal insulation. In general, the CMP process involves holding and rubbing a typically rotating wafer against a moving polishing pad under a controlled pressure and relative speed. CMP systems typically implement an orbital table or a linear belt in which a preparation surface of a polishing pad is used to polish one side of a wafer. Slurry is used to facilitate and enhance the CMP process. Slurry is most usually introduced onto a moving preparation surface and distributed over the preparation surface as well as the surface of the semiconductor wafer being buffed, polished, or otherwise prepared by the CMP process. The distribution of the slurry is generally accomplished by a combination of the movement of the preparation surface, the movement of the semiconductor wafer and the friction created between the semiconductor wafer and the preparation surface.

FIG. 1 shows a linear belt-type CMP system 100 in accordance with the prior art. The linear belt-type CMP system 100 includes a polishing head 108, which secures and holds a wafer 104 in place during CMP processing. A polishing belt and pad combination ("belt pad") 102 forms a loop around rotating drums 112, and moves in a direction 106 at a speed of up to approximately 600 feet per minute, however this speed may vary depending upon the specific CMP process. As the belt pad 102 moves, the polishing head

108 rotates in a direction 110 and lowers the wafer 104 onto the top surface (i.e., the preparation surface) of the belt pad 102. The wafer 104 is applied to the belt pad 102 with a force 118 sufficient to facilitate the CMP process. A platen 124 supports the belt pad 102 to provide a resistance to the force 118.

A nozzle 120 having a number of discrete dispense points dispenses a slurry 122 onto the top surface of the belt pad 102. Movement of the belt pad 102 in the direction 106 transports slurry 122 underneath the wafer 104. The belt pad 102 is typically configured with longitudinal grooves 103, to enhance the spread of slurry 122. The position of the nozzle 120 can be adjusted across the width of the top surface of the belt pad 102. The nozzle 120 is typically aligned in a position relative to the wafer 104 such as center on the wafer 104. However, the position of the nozzle 120 can be adjusted to somewhat optimize the uniformity of the removal of material from the surface of the wafer 104.

FIG. 2 shows a top view of the linear belt-type CMP system 100 in accordance with the prior art. The nozzle 120 dispenses the slurry 122 onto the belt pad 102 as the belt pad 102 moves in the direction 106. The slurry 122 travels underneath the polishing head 108 between the wafer 104 and belt pad 102. The force 118 transferred through the wafer 104 to the belt pad 102 causes slurry 122 to be squeezed out from under the wafer 104. As slurry 122 is squeezed from under the wafer 104, a slurry buildup 126 occurs around the periphery of the polishing head 108. Typically, not all of the slurry 122 dispensed from the nozzle 120 onto the belt pad 102 is able to pass underneath the polishing head 108. Thus, the slurry buildup 126 tends to be greater at locations where the slurry 122 is incident upon the polishing head 108. As the polishing head 108 rotates in the direction 110, adhesion forces between the slurry 122 and polishing head 108 tend to partially wrap the slurry buildup 126 around the polishing head 108. Since the slurry buildup 126 is not completely wrapped around the polishing head 108, a dry wake region 128 exists behind the polishing head 108. The dry wake region 128 characteristics are dependent on the CMP process parameters.

The slurry 122 is a fluid medium that transports reactants to the wafer 104 surface and carries reactions products away from the wafer 104 surface. The slurry 122 also plays an important role in lubricating the interface between the belt pad 102 and wafer 104 surface, ensuring an equal distribution of hydrodynamic pressure across the wafer 104 surface. Heat generated during the CMP process through friction and chemical reaction is also removed by the slurry 122 flow, helping to keep the wafer 104 temperature stable and uniform. The stability and uniformity of CMP process results across the wafer 104 surface are dependent on the slurry 122 distribution characteristics across the wafer 104 surface. The slurry 122 present in the dry wake region 128 differs from the slurry 122 that wraps around the polishing head 108 in many respects such as volume, chemistry, composition, and thermal load. As the belt pad 102 rotates around the drums 112 a fresh amount of slurry 122 from the nozzle 120 will be deposited across the belt pad 102. However, a combination of dry wake region 128 slurry 122 with fresh slurry 122 will continue to differentiate the dry wake region 128 from the remainder of the belt pad 102. As the CMP process continues, the characteristics differentiating the dry wake region 128 from the remainder of the belt pad 102 will become more pronounced.

Semiconductor technology is currently implementing the dual advances of using copper for metal-interconnects and "low-K" materials for the insulation between adjacent metal-interconnects and layers in a semiconductor wafer. FIG. 3 shows an exemplary wafer 104 film stack cross-section in accordance with the prior art. A substrate material 136 (e.g., silicon) defines a first layer of the wafer 104. The substrate material 136 is covered by a TEOS film 134. The TEOS film is covered by a low-K material film 132 wherein the low-K material has a dielectric constant less than a common insulator such as silicon dioxide. The low-K material film 132 is covered by a metallization layer 130. An interconnect 140 extending from the metallization layer 130 is also shown. In some cases, an insulating protective layer of oxide or nitride may also be present between the low-K material film 132 and the metallization layer 130. By using copper and low-K materials, the number of layers and the distance between metal-interconnects can be reduced while improving device speed and yield. However, low-K materials are typically experimental materials that may not adhere well to their underlying layer in the wafer 104. Due to this adhesion challenge between the low-K material film and its underlying layer, the CMP process should be performed in a manner that does not cause the low-K material film 132 to peel or de-laminate. Additionally, when there is a copper metallization layer on top of a low-K material film 132, the copper metallization layer may de-laminate along with the low-K material film 132. A film interface 138 in FIG. 3 shows a location where the low-K material film 132 would likely de-laminate from its underlying layer. The de-lamination of the low-K material film 132 is initiated primarily by increased stress that develops in localized areas of the wafer. The development of increased stress in localized areas of the wafer is often due to lack of uniform slurry 122 conditions across the wafer 104 surface. Lack of uniform slurry 122 volume and chemistry will serve to maximize the mechanical (i.e., abrasive) stresses in the affected areas of the wafer 104 surface. Therefore, as the slurry 122 characteristics in the dry wake region 128 become more differentiated and pronounced relative to the remainder of the belt pad 102, the probability of low-K material film 132 de-lamination increases. Once initiated, the de-lamination of the low-K material film 132 will rapidly spread across the wafer 104.

In view of the foregoing, there is a need for an apparatus and method that can be implemented in a CMP process to prevent de-lamination of wafer 104 film layers having weak adhesion characteristics.

SUMMARY OF THE INVENTION

Broadly speaking, the present invention fills these needs by providing apparatuses and methods for implementing a pulsed polishing head rotation in a linear belt-type chemical mechanical planarization (CMP) system to maintain a slurry distribution across the width of a belt pad in a manner that prevents de-lamination of a wafer film having weak adhesion characteristics. It should be appreciated that the present invention can be implemented in numerous ways, including as a process, an apparatus, a system, a device, or a method. Several embodiments of the present invention are described below.

In one embodiment, a linear belt-type chemical mechanical planarization (CMP) system is disclosed. The CMP system includes a first drum and a second drum around which a belt pad having a preparation surface and an undersurface is configured. The belt pad can have longitudinal grooves, cross-grooves, or a combination of both longitudinal grooves and cross-grooves. The belt pad is further configured to move in a linear motion as the first drum and second drum are rotated. Between the first drum and second drum, the belt pad traverses over a wafer preparation location supported underneath by a platen. A nozzle having a plurality of locations for dispensing a slurry is positioned to deliver the slurry to the wafer preparation location. The longitudinal grooves and cross-grooves of the belt pad are configured to disperse the slurry across the belt pad. A polishing head capable of receiving a wafer and rotating in a pulsed configuration is further configured to apply the wafer to the wafer preparation location. The pulsed configuration of the polishing head is adjustable in frequency. At a sufficiently high frequency, the pulsed configuration of the polishing head transitions to an oscillated configuration.

In another embodiment, a method for operating a CMP system using a pulsed polishing head rotation is disclosed. The method includes a first operation of moving a belt pad having a coverage of slurry. In a second operation, a polishing head is rotated in a first direction. In a third operation, the polishing head is applied to the belt pad for a first duration while the polishing head is rotating in the first direction. Upon completion of the first duration, a fourth operation is performed wherein the polishing head is removed from the belt pad. In a fifth operation, the polishing head is rotated in a second direction. In a sixth operation, the polishing head is applied to the belt pad for a second duration while the polishing head is rotating in the second direction. Upon completion of the second duration, the method continues by looping back to the second operation.

In another embodiment, a method for operating a CMP system using a pulsed polishing head rotation is disclosed. The method includes a first operation of moving a belt pad having a coverage of slurry. In a second operation, a polishing head is rotated in a first direction. In a third operation, the polishing head is applied to the belt pad for a first duration while the polishing head is rotating in the first direction. Upon completion of the first duration, a fourth operation is performed wherein the polishing head remains applied to the belt pad while being rotated in a second direction. The fourth operation continues for a second duration. Upon completion of the second duration, the method continues by looping back to the third operation.

In another embodiment, a method for operating a CMP system using an oscillated polishing head rotation is disclosed. The method includes a first operation of moving a belt pad having a coverage of slurry. In a second operation, a polishing head is rotated in a first direction. In a third operation, the polishing head is applied to the belt pad for a first period of time while the polishing head is rotating in the first direction. Alternative to the first period of time, the polishing head may be rotated in the first direction through a first finite angular distance. Upon completion of either the first duration or the first finite angular distance, a fourth operation is performed wherein the polishing head remains applied to the belt pad while being rotated in a second direction. The fourth operation continues either for a second duration or until the polishing head has been rotated through a second finite angular distance. Upon completion of the second duration, the method continues by looping back to the third operation.

The advantages of the present invention are numerous. Most notably, the use of the pulsed polishing head rotation as disclosed in the present invention avoids the problems of the prior art by maintaining the slurry distribution across the width of the belt pad. The slurry distribution is maintained in a manner that prevents de-lamination of wafer film layers having weak or potentially weaker adhesion characteristics.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for an apparatus and method for pulsing and oscillating a polishing head in a linear belt-type chemical mechanical planarization (CMP) system to prevent de-lamination of semiconductor wafer film layers having weak adhesion characteristics. Broadly speaking, the present invention implements either a pulsed or oscillated polishing head rotation during a CMP process to maintain a slurry distribution across the width of a belt pad in a manner that prevents de-lamination of a wafer film having weak adhesion characteristics. Thus, the pulsed and oscillated polishing head rotation of the present invention eliminates the problems of the prior art by preventing de-lamination of low-K material film layers during a CMP process.

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
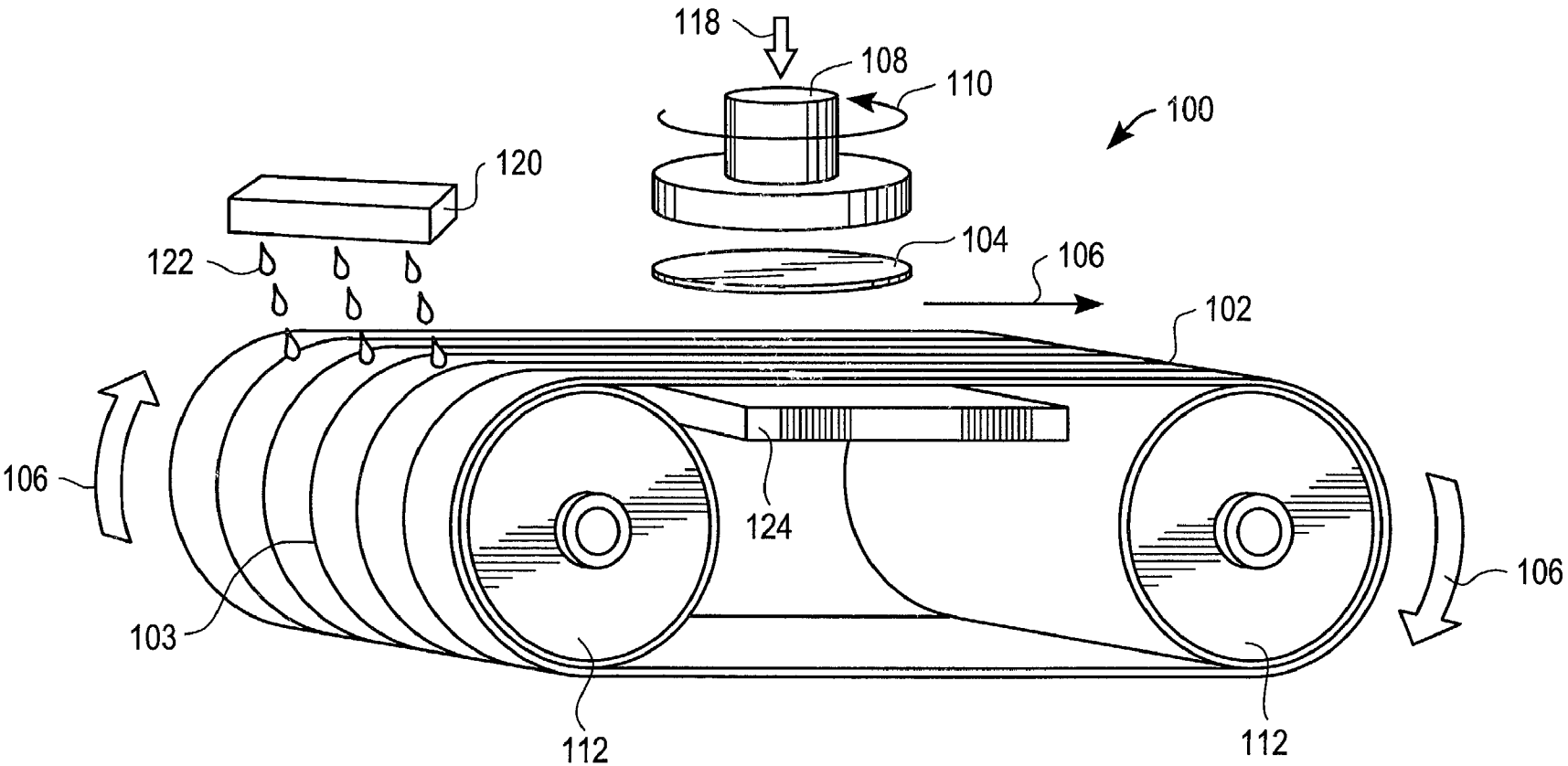
FIG. 1 (PRIOR ART)
FIG. 1 is an illustration showing a linear belt-type CMP system in accordance with the prior art.
Figure 2:
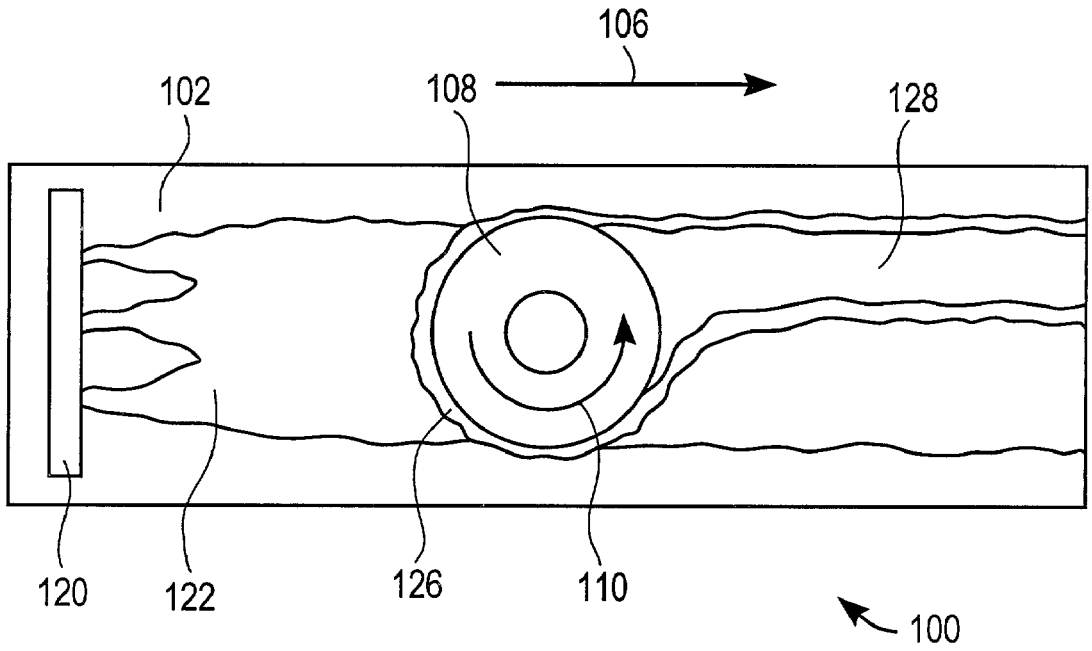
FIG. 2 (PRIOR ART)
FIG. 2 is an illustration showing a top view of the linear belt-type CMP system in accordance with the prior art.
Figure 3:
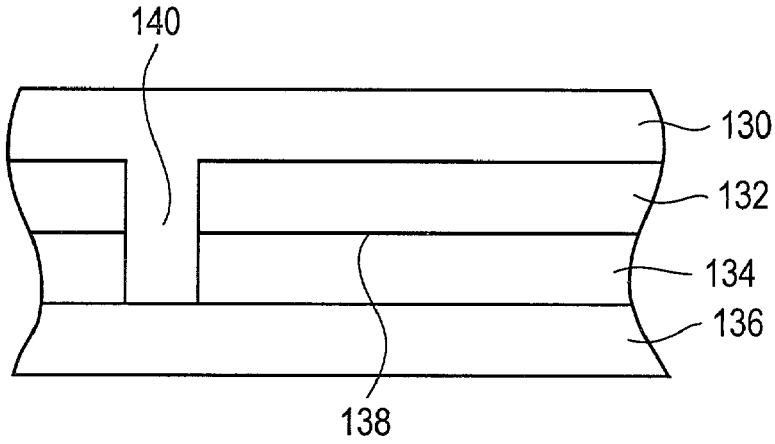
FIG. 3 (PRIOR ART)
FIG. 3 is an illustration showing an exemplary wafer film stack cross-section in accordance with the prior art.
Figure 4A:
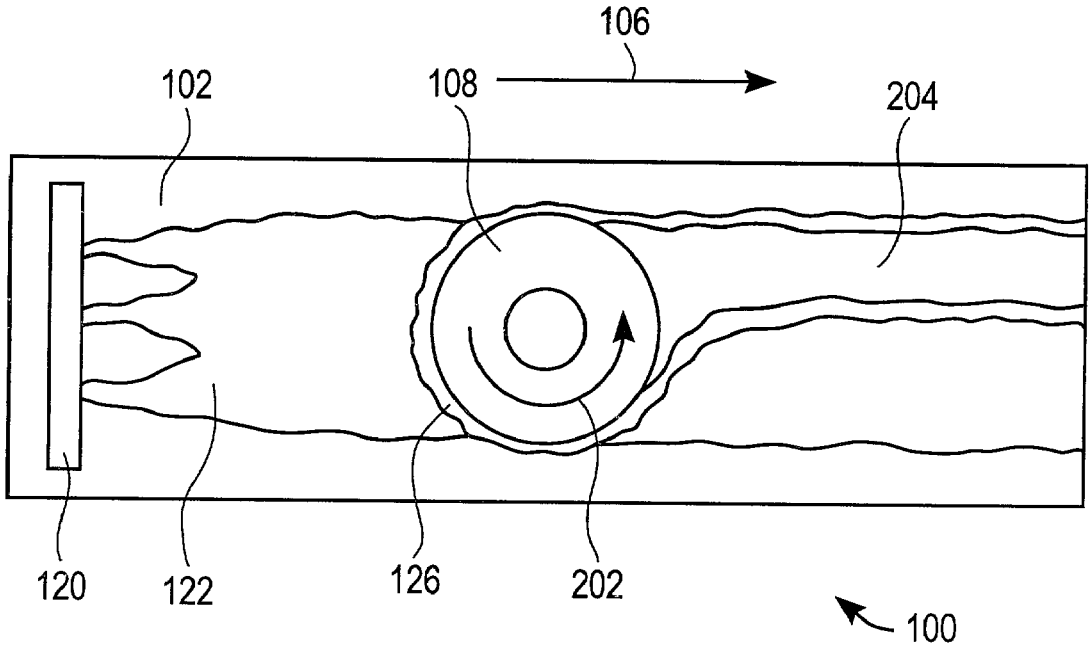
FIG. 4A is an illustration showing a top view of the linear belt-type CMP system implementing a first part of a pulsed polishing head rotation in accordance with one embodiment of the present invention.
Figure 4B:
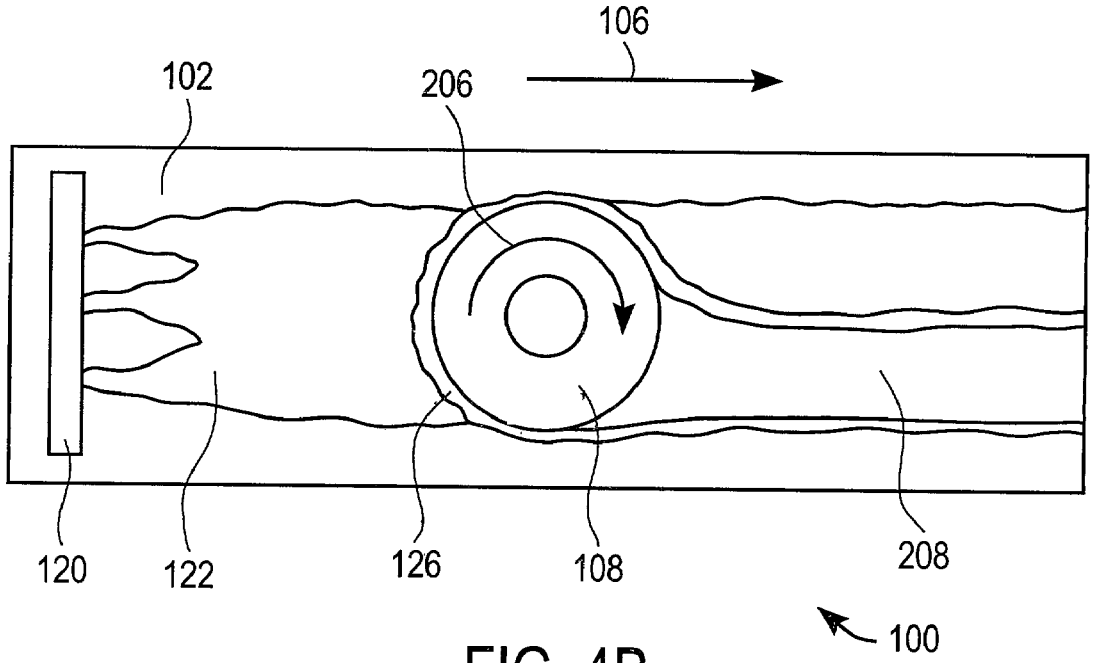
FIG. 4B is an illustration showing a top view of the linear belt-type CMP system implementing a second part of a pulsed polishing head rotation in accordance with one embodiment of the present invention.

FIGS. 4A and 4B show top views of the linear belt-type CMP system 100 implementing a pulsed polishing head 108 rotation in accordance with one embodiment of the present invention. In FIG. 4A, the polishing head 108 is rotating in a first direction 202. In FIG. 4B, the polishing head 108 is rotating in a second direction 206. As shown in FIG. 4A, a first dry wake region 204 exists on a side of the polishing head 108 opposite the nozzle 120. The slurry buildup 126 wraps around the polishing head 108 in the first direction 202 of rotation such that the first dry wake region 204 exists primarily on one side of the polishing head 108. As shown in FIG. 4B, a second dry wake region 208 also exists on the side of the polishing head 108 opposite the nozzle 120. The slurry buildup 126 wraps around the polishing head 108 in the second direction 206 of rotation such that the second dry wake region 208 exists primarily on a side of the polishing head 108 that is opposite the side occupied by the first dry wake region 204.

During the pulsed polishing head 108 rotation, the duration over which the polishing head 108 rotates in the first direction 202 and the second direction 206 is monitored and controlled. By controlling the duration of rotation in the first direction 202 and the second direction 206, the first dry wake region 204 and the second dry wake region 208 are controlled. Controlling the duration of the first dry wake region 204 and the second dry wake region 208 serves to maintain a more uniform time-averaged slurry 122 characteristic distribution across the belt pad 102.

Figure 5:
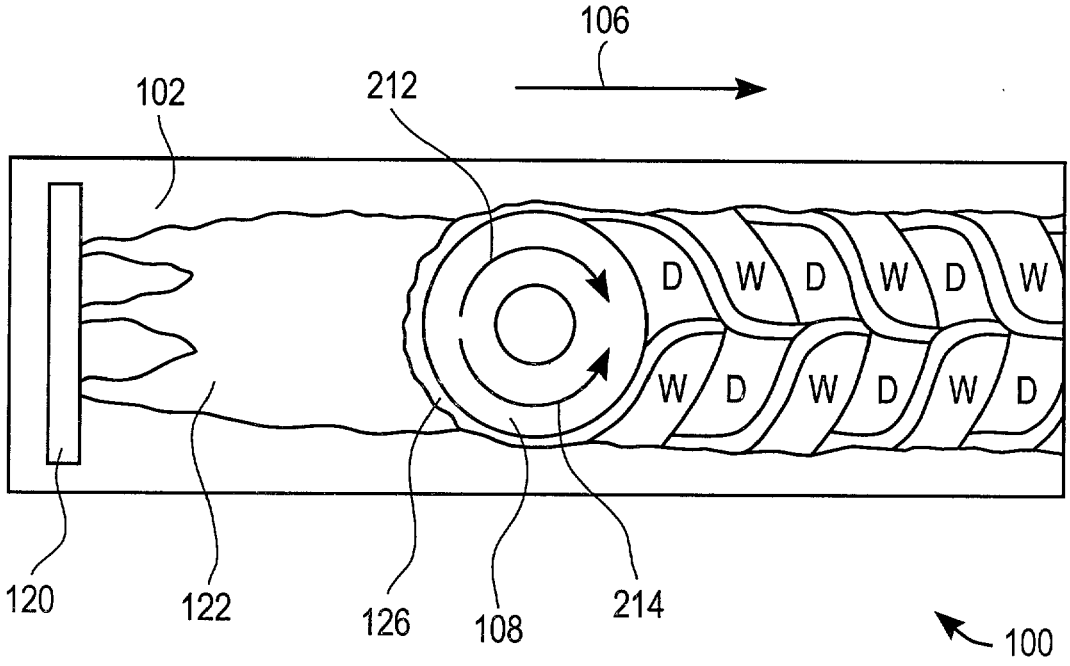
FIG. 5 is an illustration showing a top view of the linear belt-type CMP system implementing an oscillated polishing head rotation in accordance with one embodiment of the present invention.

FIG. 5 shows a top view of the linear belt-type CMP system 100 implementing an oscillated polishing head 108 rotation in accordance with one embodiment of the present invention. In the oscillated polishing head 108 rotation method, the polishing head 108 rotates in a first oscillation direction 214 and a second oscillation direction 212. A frequency of oscillation is set sufficiently high such that a number of staggered pseudo-dry wake regions D and a number of staggered wet (i.e., slurry 122 covered) regions W exist behind the polishing head 108 opposite the nozzle 120. The frequency of oscillation is established either by setting a rotation time for each oscillation direction or by setting a finite angular distance of travel for each oscillation direction. For example, the polishing head 108 may be programmed to successively perform rotations of 180° in the first oscillation direction 214 followed by 180° in the second oscillation direction 212. There are no restrictions on either the angular velocity or angular distance of travel for each oscillation direction other than being consistent with the CMP process requirements. Due to the limited time period over which each of the pseudo-dry wake regions D are developed and exist, the time-averaged slurry 122 characteristics of the pseudo-dry wake regions D remain substantially the same as those across the remainder of the belt pad 102. Thus, implementation of the oscillated polishing head 108 rotation method serves to maintain a more uniform slurry 122 characteristic distribution across the belt pad 102.

Both the pulsed and the oscillated polishing head 108 rotation methods result in maintaining a uniform slurry 122 characteristic distribution across the belt pad 102. Some important slurry 122 characteristics maintained in a uniform manner across the belt pad 102 by implementing either the pulsed or the oscillated rotation methods include volume, chemistry, composition, and thermal load. By maintaining a uniform distribution of slurry 122 characteristics across the belt pad 102, de-lamination of wafer 104 film layers having weak adhesion characteristics is prevented.

Figure 6A:
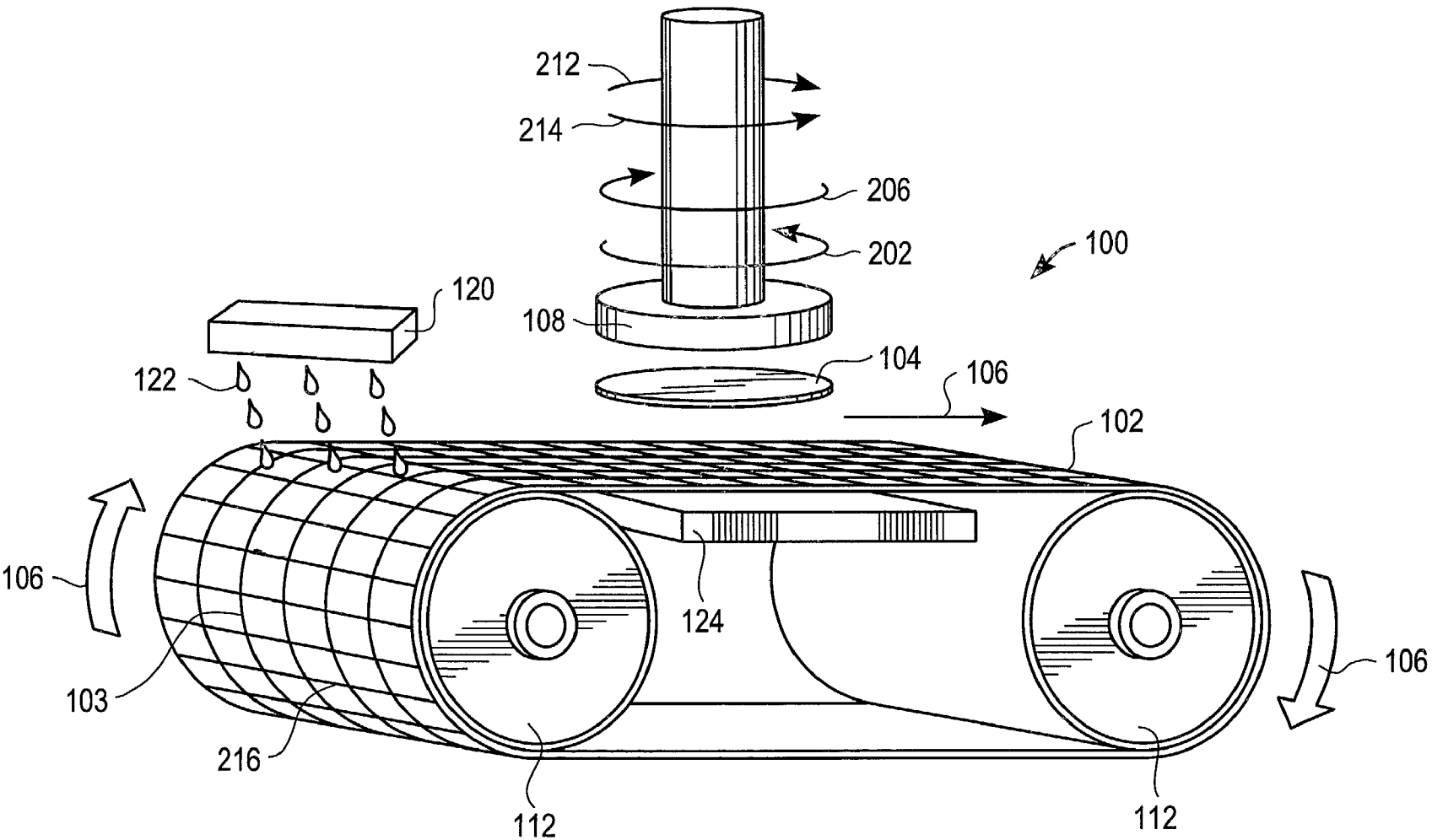
FIG. 6A is an illustration showing the implementation of both the pulsed and the oscillated polishing head rotation methods in a linear belt-type CMP system in accordance with a preferred embodiment of the present invention wherein the belt pad contains both longitudinal grooves and cross-grooves.

FIG. 6A shows the implementation of both the pulsed and the oscillated polishing head 108 rotation methods in a linear belt-type CMP system 100 in accordance with a preferred embodiment of the present invention wherein the belt pad 102 contains both longitudinal grooves 103 and cross-grooves 216. The longitudinal grooves 103 and cross-grooves 216 channel slurry 122 from regions of higher volume to regions of lower volume thus facilitating the distribution of slurry 122 across the belt pad 102. Use of the longitudinal grooves 103 and cross-grooves 216 in combination with either the pulsed or oscillated polishing head 108 rotation methods results in a uniform distribution of slurry 122 characteristics across the belt pad 102.

Figure 6B:
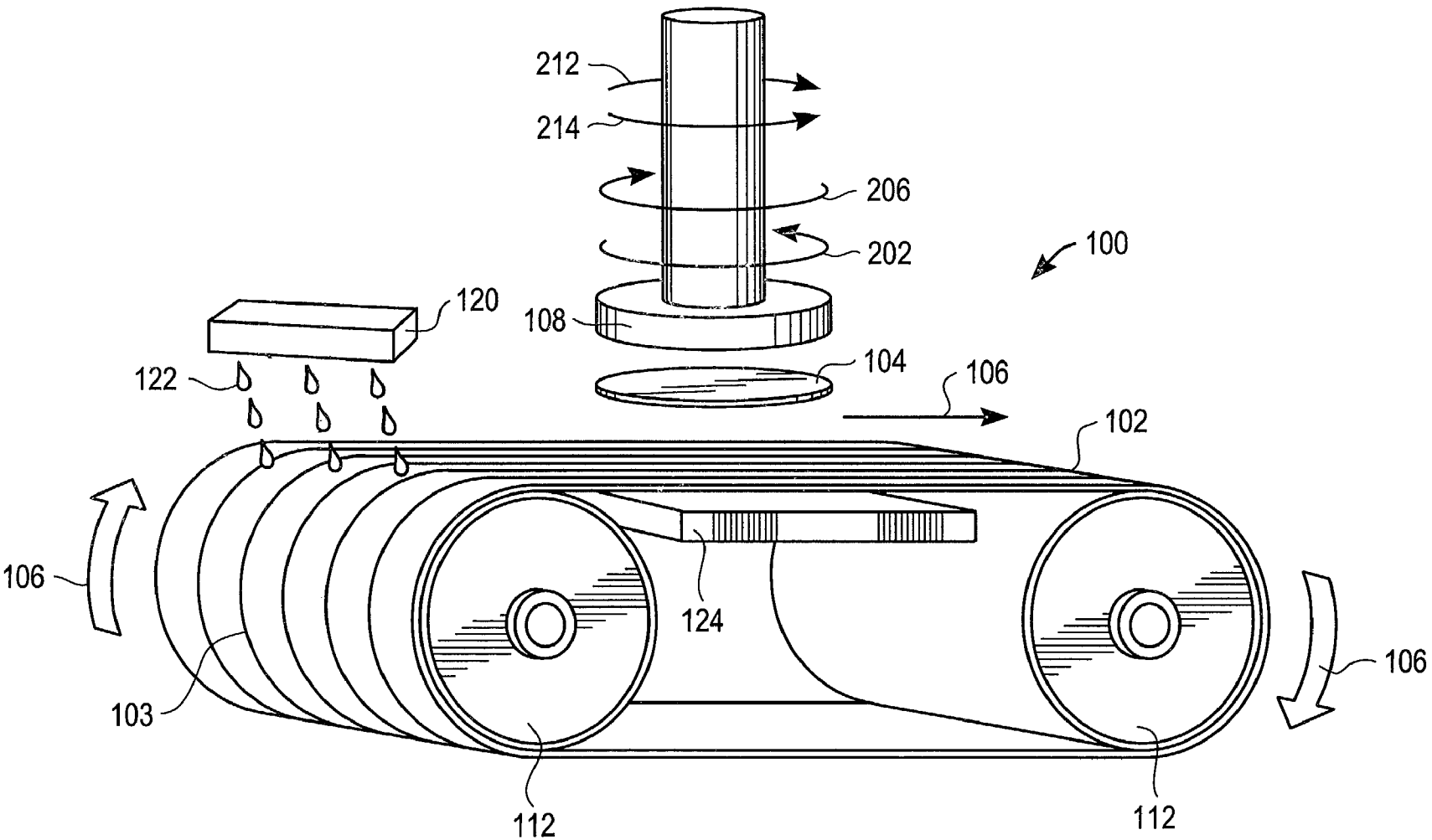
FIG. 6B is an illustration showing the implementation of both the pulsed and the oscillated polishing head rotation methods in a linear belt-type CMP system in accordance with an alternate embodiment of the present invention wherein the belt pad contains only longitudinal grooves.

FIG. 6B shows the implementation of both the pulsed and the oscillated polishing head 108 rotation methods in a linear belt-type CMP system 100 in accordance with an alternate embodiment of the present invention wherein the belt pad 102 contains only longitudinal grooves 103. The belt pad 102 configuration containing only longitudinal grooves 103 channels slurry 122 in longitudinal directions from regions of higher volume to regions of lower volume. Therefore, implementation of either the pulsed or oscillated polishing head 108 rotation methods is important for maintaining a uniform slurry 122 distribution across the width of the belt pad 102 (i.e., in a non-longitudinal direction).

Figure 7:
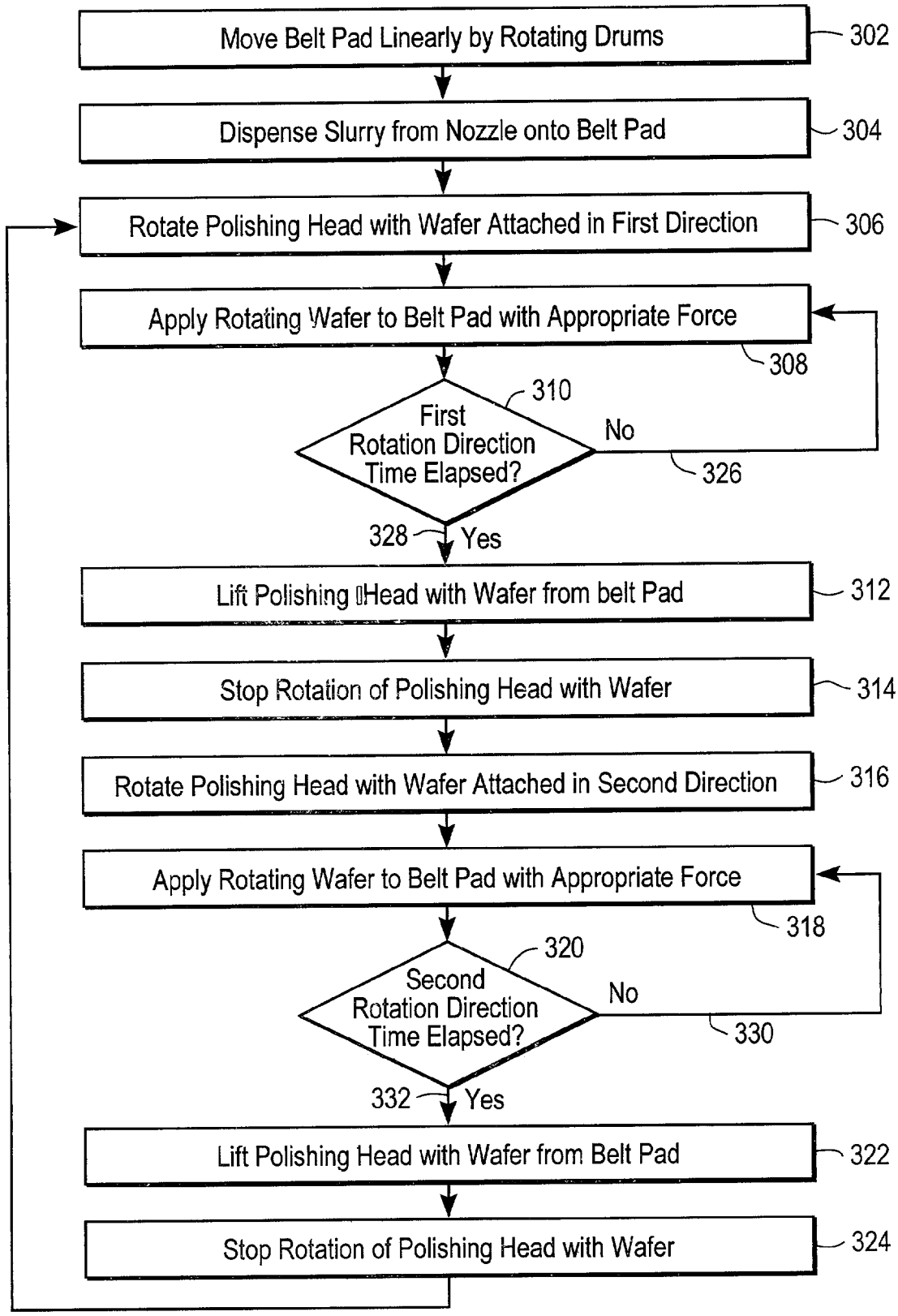
FIG. 7 is an illustration showing a flowchart of the pulsed polishing head rotation method in accordance with a preferred embodiment of the present invention.

FIG. 7 shows a flowchart illustrating the pulsed polishing head 108 rotation method in accordance with a preferred embodiment of the present invention. The method starts with a linear movement of the belt pad 102 around the rotating drums 112 as shown by a step 302. A step 304 follows wherein the slurry 122 is dispensed from the nozzle 120 onto the belt pad 102. The polishing head 108 with the wafer 104 attached is rotated in the first direction 202 as shown in a step 306. After the polishing head 108 begins rotating in step 306, a step 308 is performed wherein the polishing head 108 is lowered to apply the wafer 104 to the polishing belt 102 with a force 118 that is appropriate for the CMP process. A decision step 310 in combination with a "no" branch 326 and a "yes" branch 328 requires continued application of the wafer 104 to the belt pad 102 while rotating in the first direction 202 until a first rotation direction time has elapsed. Upon completion of the first rotation direction time, a step 312 is performed wherein the polishing head 108 and wafer 104 are lifted from the belt pad 102. A step 314 then stops rotation of the polishing head 108 in the first direction 202. A step 316 then begins rotation of the polishing head 108 in the second direction 206. A step 318 is then performed wherein the polishing head 108 with wafer 104 attached is lowered to apply the wafer 104 to the polishing belt 102 with a force 118 that is appropriate for the CMP process. A decision step 320 in combination with a "no" branch 330 and a "yes" branch 332 requires continued application of the wafer 104 to the belt pad 102 while rotating in the second direction 206 until a second rotation direction time has elapsed. Upon completion of the second rotation direction time, a step 322 is performed wherein the polishing head 108 and wafer 104 are lifted from the belt pad 102. A step 324 then stops rotation of the polishing head 108 in the second direction 206. The method then continues by looping back to step 306 wherein rotation of the polishing head 108 in the first direction 202 begins again. The application and removal of the wafer 104 to the belt pad 102 while rotating in alternate first and second directions continues until the CMP process is completed. The CMP process may be terminated at any point during the pulsed polishing head 108 rotation method.

In an alternate embodiment, the pulsed polishing head 108 rotation method may be performed without removing the wafer 104 from the belt pad 102. In this alternate embodiment, steps 312 and 322 are eliminated from the method as illustrated in FIG. 7. By eliminating the polishing head 108 and wafer 104 lifting steps, the time required to complete the CMP process is reduced, thus enhancing the CMP process throughput. However, the decision to incorporate or remove steps 312 and 322 from the pulsed polishing head 108 rotation method is based on the requirements of the particular CMP process.

Figure 8:
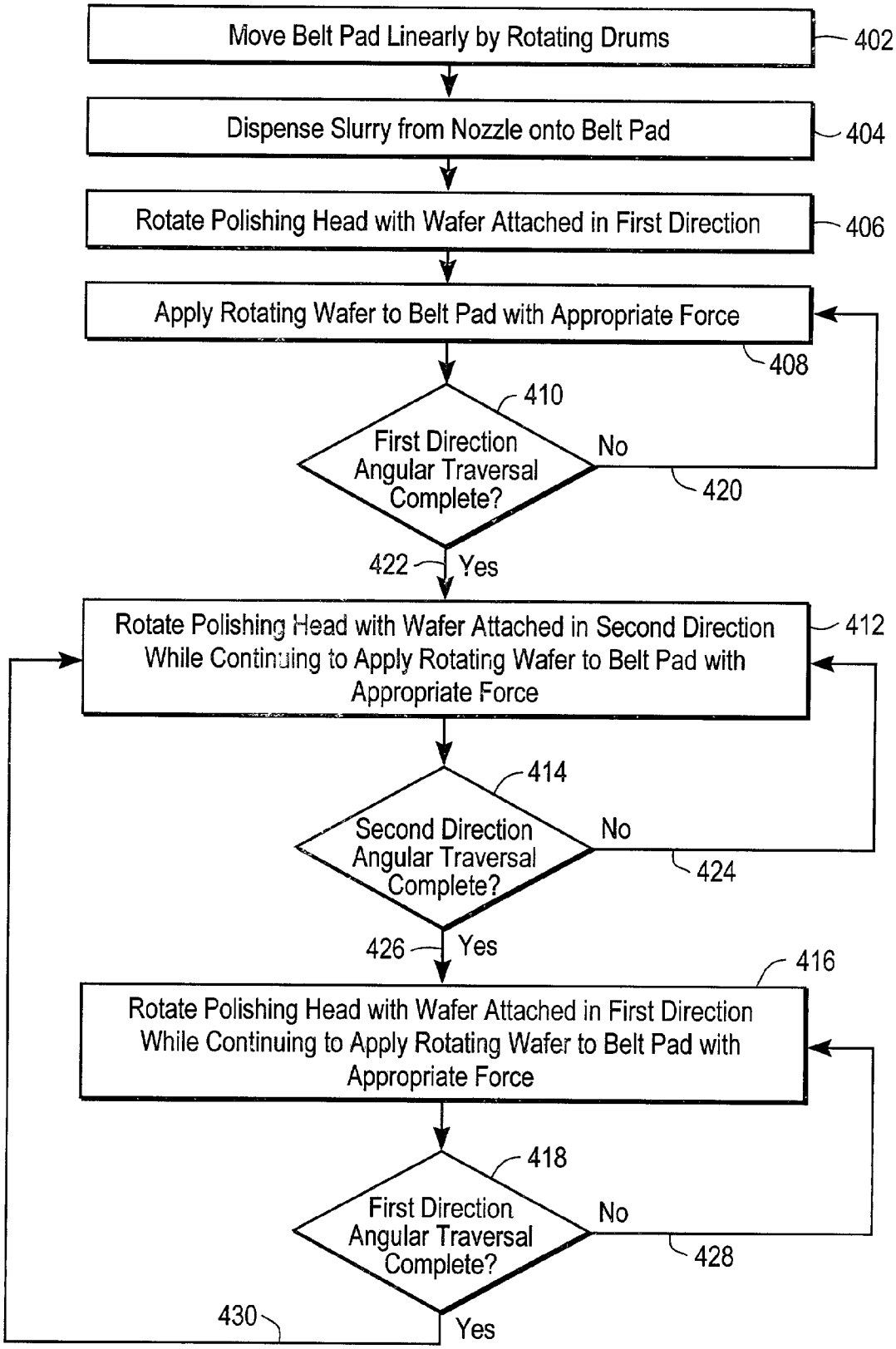
FIG. 8 is an illustration showing a flowchart of the oscillated polishing head rotation method in accordance with a preferred embodiment of the present invention.

FIG. 8 shows a flowchart illustrating the oscillated polishing head 108 rotation method in accordance with a preferred embodiment of the present invention. The method starts with a linear movement of the belt pad 102 around the rotating drums 112 as shown by a step 402. A step 404 follows wherein the slurry 122 is dispensed from the nozzle 120 onto the belt pad 102. The polishing head 108 with the wafer 104 attached is rotated in the first oscillation direction 214 as shown in a step 406. After the polishing head 108 begins rotating in step 406, a step 408 is performed wherein the polishing head 108 is lowered to apply the wafer 104 to the polishing belt 102 with a force 118 that is appropriate for the CMP process. A decision step 410 in combination with a "no" branch 420 and a "yes" branch 422 requires continued application of the wafer 104 to the belt pad 102 while rotating in the first oscillation direction 214 until a first angular rotation distance has been traversed. Upon complete traversal of the first angular rotation distance, a step 412 is performed wherein the polishing head 108 and wafer 104 are rotated in the second oscillation direction 212. A transition between the first oscillation direction 214 and the second oscillation direction 212 occurs while the wafer 104 remains applied to the belt pad 102. A decision step 414 in combination with a "no" branch 424 and a "yes" branch 426 requires continued application of the wafer 104 to the belt pad 102 while rotating in the second oscillation direction 212 until a second angular rotation distance has been traversed. Upon complete traversal of the second angular rotation distance, a step 416 is performed wherein the polishing head 108 and wafer 104 are rotated in the first oscillation direction 214. A transition between the second oscillation direction 212 and the first oscillation direction 214 occurs while the wafer 104 remains applied to the belt pad 102. A decision step 418 in combination with a "no" branch 428 and a "yes" branch 430 requires continued application of the wafer 104 to the belt pad 102 while rotating in the first oscillation direction 214 until the first angular rotation distance has again been traversed. Upon complete traversal of the first angular rotation distance, the method then continues by looping back to step 412 wherein rotation of the polishing head 108 in the second oscillation direction 212 begins again. Rotation of the polishing head 108 in the first oscillation direction 214 and the second oscillation direction 212 continues until the CMP process is completed. The CMP process may be terminated at any point during the oscillated polishing head 108 rotation method.

In an alternate embodiment, the first angular rotation distance and the second angular rotation distance are replaced with a first rotation time and a second rotation time, respectively. This alternate embodiment of the oscillated polishing head 108 rotation method is similar to the pulsed polishing head 108 rotation method wherein the wafer 104 is not removed from the belt pad 102 and a high frequency of rotation direction change is implemented.

Wafer 104 film layers having weak adhesion properties (e.g., low-K material film layers) are subject to de-lamination initiated by mechanical stresses present on the wafer 104 surface. Normal mechanical stresses present on the wafer 104 surface during the CMP process are increased in the presence of non-uniform slurry 122 conditions across the wafer 104 surface. Hence, non-uniform slurry 122 volume, chemistry, composition, and thermal load will serve to increase the mechanical stresses across the wafer 104 surface. Since a dry wake region represents a non-uniform slurry condition, it is important to minimize the differentiating characteristics of the dry wake region with respect to the remainder of the belt pad 102. Both the pulsed polishing head 108 rotation method and the oscillated polishing head 108 rotation method of the present invention serve to minimize slurry 122 non-uniformity across the belt pad. Therefore, the present invention implemented in either its preferred or alternate embodiments will reduce de-lamination of wafer film layers having weak adhesion properties, such as a low-K material film layer.

While this invention has been described in terms of several embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A method for operating a linear-type chemical mechanical planarization (CMP) system, comprising:

moving a belt pad having a coverage of a slurry in a linear direction;

affixing a wafer to a polishing head;

rotating a polishing head and the wafer affixed thereto in a first direction about an axis extending through a centerpoint of the polishing head and perpendicular to an angular direction of rotation of the polishing head;

applying the rotating wafer to the moving belt pad, application of the rotating wafer to the moving belt pad causing a dry wake region to form on a portion of the belt pad having traversed below the rotating wafer; and controlling the dry wake region to maintain a uniform time-averaged slurry distribution across the belt pad.

2. A method for operating a linear-type CMP system as recited in claim 1, wherein the slurry flows through longitudinal grooves and cross-grooves to cover the belt pad.

3. A method for operating a linear-type CMP system as recited in claim 1, wherein the uniform time-averaged slurry distribution across the belt pad includes a uniform time-averaged slurry volume across the belt pad, a uniform time-averaged slurry chemistry across the belt pad, and a uniform time-averaged slurry thermal load across the belt pad.

4. A method for operating a linear-type CMP system as recited in claim 1, wherein controlling the dry wake region includes, (a) rotating the polishing head and wafer in the first direction for a particular duration, (b) following operation (a), rotating the polishing head and wafer in a second direction for the particular duration, and (c) repeating operations (a) and (b).

5. A method for operating a linear-type CMP system as recited in claim 4, wherein the wafer remains applied to the moving belt pad when changing the polishing head and wafer direction of rotation.

6. A method for operating a linear-type CMP system as recited in claim 1, wherein controlling the dry wake region includes, (a) rotating the polishing head and wafer in the first direction through a particular angular distance, (b) following operation (a), rotating the polishing head and wafer in a second direction through the particular angular distance, and (c) repeating operations (a) and (b).

7. A method for operating a linear-type CMP system as recited in claim 6, wherein the wafer remains applied to the moving belt pad when changing the polishing head and wafer direction of rotation.

* * * * *